US010723963B2

(12) United States Patent
Ramaseshan et al.

(10) Patent No.: US 10,723,963 B2
(45) **Date of Patent: *Jul. 28, 2020**

(54) INTEGRATED RESIDUUM HYDROCRACKING AND HYDROFINISHING

(71) Applicant: Saudi Arabian Oil Company, Dhahran (SA)

(72) Inventors: Vinod Ramaseshan, Ras Tanura (SA); Yufeng He, Al Khobar (SA); Hiren Shethna, Dhahran (SA); Mohammed A. AlWohaibi, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

This patent is subject to a terminal disclaimer.

(21) Appl. No.: 16/115,793

(22) Filed: Aug. 29, 2018

(65) Prior Publication Data

US 2019/0062654 A1 Feb. 28, 2019

Related U.S. Application Data

(60) Provisional application No. 62/551,374, filed on Aug. 29, 2017.

(51) Int. Cl.
*C10G 65/12* (2006.01)
*C10G 65/10* (2006.01)

(52) U.S. Cl.
CPC ..... *C10G 65/12* (2013.01); *C10G 65/10* (2013.01); *C10G 2300/1077* (2013.01)

(58) Field of Classification Search
CPC ..... C10G 65/12
See application file for complete search history.

(56) References Cited

U.S. PATENT DOCUMENTS 2,950,241 A 8/1960 Craft et al.
3,147,210 A 9/1964 Hass et al.
(Continued)

FOREIGN PATENT DOCUMENTS

CN 102311798 1/2012
CN 102311799 1/2012
(Continued)

OTHER PUBLICATIONS

International Search Report and Written Opinion issued in International Application No. PCT/US2018/048426 dated Oct. 30, 2018, 13 pages.

(Continued)

*Primary Examiner* — Renee Robinson
(74) *Attorney, Agent, or Firm* — Fish & Richardson P.C.

(57) ABSTRACT

Techniques for processing residuum include receiving a feed stream that includes a residuum hydrocarbon fraction at an ebullated bed hydroconversion reactor; contacting the residuum hydrocarbon fraction with hydrogen and a hydroconversion catalyst in the ebullated bed hydroconversion reactor to produce a partially converted reactor effluent product; separating, in a first separation zone, the partially converted reactor effluent product into a distillate stream and a heavy hydrocarbon stream; feeding the distillate stream to a bottom portion of an integrated hydrocracking/hydrofinishing reactor; and feeding the heavy hydrocarbon stream to a top portion of the hydrofinishing reactor.

32 Claims, 5 Drawing Sheets

(56) References Cited

U.S. PATENT DOCUMENTS

| | | | | |
|---|---|---|---|---|
| 3,256,178 | A | 6/1966 | Hass et al. | |
| 4,082,647 | A | 4/1978 | Hutchings et al. | |
| 4,211,635 | A | 7/1980 | Chen | |
| 4,239,616 | A | 12/1980 | Gearhart | |
| 4,317,711 | A | 3/1982 | Yan | |
| 5,013,247 | A | 5/1991 | Watson | |
| 5,322,829 | A | 6/1994 | Artes et al. | |
| 5,904,835 | A | 5/1999 | Thakkar | |
| 6,179,995 | B1 | 1/2001 | Cash et al. | |
| 6,270,654 | B1 | 8/2001 | Colyar et al. | |
| 6,299,759 | B1 * | 10/2001 | Bradway | B01J 8/0453 208/108 |
| 6,312,586 | B1 | 11/2001 | Kalnes et al. | |
| 6,436,279 | B1 | 8/2002 | Colyar | |
| 6,547,956 | B1 | 4/2003 | Mukherjee et al. | |
| 7,238,275 | B2 | 7/2007 | Stupin et al. | |
| 7,279,090 | B2 | 10/2007 | Colyar et al. | |
| 7,547,386 | B1 | 6/2009 | Thakkar et al. | |
| 7,622,034 | B1 | 11/2009 | Thakkar et al. | |
| 7,686,941 | B2 | 3/2010 | Brierley et al. | |
| 7,708,877 | B2 | 5/2010 | Farshid et al. | |
| 7,938,952 | B2 | 5/2011 | Colyar et al. | |
| 8,110,090 | B2 | 2/2012 | Zimmerman et al. | |
| 8,133,446 | B2 | 3/2012 | McGehee et al. | |
| 8,193,401 | B2 | 6/2012 | McGehee et al. | |
| 9,074,143 | B2 | 7/2015 | McGehee et al. | |
| 9,440,894 | B2 | 9/2016 | Baldassari et al. | |
| 9,687,804 | B2 | 6/2017 | Mukherjee et al. | |
| 2006/0118463 | A1 | 6/2006 | Colyar et al. | |
| 2008/0149534 | A1 | 6/2008 | Gauthier et al. | |
| 2009/0288984 | A1 * | 11/2009 | Colyar | C10G 11/16 208/49 |
| 2009/0308788 | A1 | 12/2009 | Lenglet | |
| 2010/0122934 | A1 | 5/2010 | Haizmann et al. | |
| 2011/0139676 | A1 | 6/2011 | McGehee et al. | |
| 2011/0139681 | A1 | 6/2011 | McGehee et al. | |
| 2011/0142729 | A1 | 6/2011 | McGehee et al. | |
| 2012/0061293 | A1 | 3/2012 | Sanchez et al. | |
| 2012/0234726 | A1 * | 9/2012 | Morel | B01J 27/30 208/49 |
| 2014/0138287 | A1 | 5/2014 | De Klerk et al. | |
| 2014/0221709 | A1 | 8/2014 | Baldassari et al. | |
| 2014/0238903 | A1 | 8/2014 | Irudayaraj et al. | |
| 2015/0038599 | A1 | 2/2015 | Kresnyak | |
| 2015/0329790 | A1 * | 11/2015 | Yang | C10G 65/10 208/59 |
| 2016/0068767 | A1 | 3/2016 | Harvey et al. | |

FOREIGN PATENT DOCUMENTS

| | | |
|---|---|---|
| CN | 102652169 | 8/2012 |
| CN | 103102944 | 5/2013 |
| CN | 103102945 | 5/2013 |
| CN | 103102980 | 5/2013 |
| CN | 103102982 | 5/2013 |
| JP | 2014524967 | 9/2014 |
| OA | 12971 | 10/2006 |
| WO | 2009003633 | 1/2009 |
| WO | 2009062088 | 5/2009 |
| WO | 2010004126 | 1/2010 |
| WO | 2010004127 | 1/2010 |
| WO | 2010004128 | 1/2010 |
| WO | 2010053865 | 5/2010 |
| WO | 2010056436 | 5/2010 |
| WO | 2011071705 | 6/2011 |
| WO | 2015082313 | 6/2015 |

OTHER PUBLICATIONS

Spieler et al., "Am-06-64: Upgrading Residuum to Finished Products in Integrated Hydroprocessing Platforms: Solutions and Challenges," NPRA (National Petrochemical and Refiners Association), Annual Meeting, Mar. 19-21, 2006, 19 pages.

International Search Report and Written Opinion issued in International Application No. PCT/US2018/037694 dated Sep. 26, 2018, 18 pages.

GCC Examination Report in Appln. No. GC 2018-35493, dated Dec. 25, 2019, 3 pages.

* cited by examiner

INTEGRATED RESIDUUM HYDROCRACKING AND HYDROFINISHING

CROSS-REFERENCE TO RELATED APPLICATION

This application claims priority under 35 U.S.C. § 119 to U.S. Provisional Patent Application Ser. No. 62/551,374, filed on Aug. 29, 2017, and entitled "INTEGRATED RESIDUUM HYDROCRACKING & HYDROFINISHING," the entire contents of which are incorporated by reference herein.

TECHNICAL FIELD

This disclosure relates to systems and processes for converting carbon-rich hydrocarbons to carbon-poor hydrocarbons in an integrated hydroprocessing unit.

BACKGROUND

Recent trends in refining encourage refiners to operate on heavier crudes and maximize white oil products. Future sulfur level reduction in high sulfur fuel oil (HSFO) may also encourage refiners to upgrade the bottom of the barrel. In many refineries, there are limitations imposed in existing crude distillation columns when processing heavy crudes (or different crudes).

SUMMARY

In an example general implementation, a method for processing residuum includes receiving a feed stream that includes a residuum hydrocarbon fraction at an ebullated bed hydroconversion reactor; contacting the residuum hydrocarbon fraction with hydrogen and a hydroconversion catalyst in the ebullated bed hydroconversion reactor to produce a partially converted reactor effluent product; separating, in a first separation zone, the partially converted reactor effluent product into a distillate stream and a heavy hydrocarbon stream; feeding the distillate stream to a bottom portion of an integrated hydrocracking/hydrofinishing reactor; and feeding the heavy hydrocarbon stream to a top portion of the hydrofinishing reactor.

An aspect combinable with the general implementation further includes combining the heavy hydrocarbon stream with a recycle gas stream to form a mixed stream prior to feeding the heavy hydrocarbon stream to the top portion of the hydrofinishing reactor.

Another aspect combinable with any of the previous aspects further includes feeding the mixed stream to the top portion of the hydrofinishing reactor.

Another aspect combinable with any of the previous aspects further includes prior to feeding the heavy hydrocarbon stream to the top portion of the hydrofinishing reactor, fractionating the heavy hydrocarbon stream into a light hydrocarbon stream, a heavy gas oil stream, and an unconverted residuum stream in a vacuum distillation column.

Another aspect combinable with any of the previous aspects further includes feeding the heavy gas oil stream to the top portion of the hydrofinishing reactor.

Another aspect combinable with any of the previous aspects further includes contacting the heavy gas oil stream with hydrogen and hydroconversion catalyst in the hydrofinishing reactor.

In another aspect combinable with any of the previous aspects, the hydrofinishing reactor includes a multiple bed reactor.

Another aspect combinable with any of the previous aspects further includes supplying at least one hydrogen quench stream to the hydrofinishing reactor.

Another aspect combinable with any of the previous aspects further includes prior to feeding the distillate stream to the bottom portion of the hydrofinishing reactor, mixing the distillate stream with light liquid stream recovered from a low temperature, high pressure separator of the first separation zone.

Another aspect combinable with any of the previous aspects further includes feeding the mixed stream to the bottom portion of the hydrofinishing reactor.

Another aspect combinable with any of the previous aspects further includes feeding an effluent stream from the hydrofinishing reactor to a second separation zone.

Another aspect combinable with any of the previous aspects further includes separating, in a high temperature, high pressure separator of the second separation zone, the effluent stream into a light stream and a heavy oil stream.

Another aspect combinable with any of the previous aspects further includes feeding the light stream to a top portion of a polishing hydrotreating reactor.

Another aspect combinable with any of the previous aspects further includes feeding the heavy oil stream to a high temperature, low pressure separator of the second separation zone.

Another aspect combinable with any of the previous aspects further includes mixing the light stream with the mixed stream from the low temperature, high pressure separator of the first separation zone.

Another aspect combinable with any of the previous aspects further includes subsequent to the mixing, feeding the mixed stream to the top portion of the polishing hydrotreating reactor.

Another aspect combinable with any of the previous aspects further includes outputting an effluent from the polishing hydrotreating reactor to a low temperature, high pressure separator of the second separation zone.

Another aspect combinable with any of the previous aspects further includes feeding the light stream from the high temperature, high pressure separator of the second separation zone to a bottom portion of a polishing hydrotreating reactor.

Another aspect combinable with any of the previous aspects further includes feeding the mixed stream from the low temperature, high pressure separator of the first separation zone to a top portion of the polishing hydrotreating reactor.

Another aspect combinable with any of the previous aspects further includes supplying a hydrogen quench stream to the polishing hydrotreating reactor.

Another aspect combinable with any of the previous aspects further includes mixing the mixed stream from the low temperature, high pressure separator of the first separation zone with a recycle gas stream.

Another aspect combinable with any of the previous aspects further includes subsequent to the mixing, feeding the mixed stream to the top portion of the polishing hydrotreating reactor.

Another aspect combinable with any of the previous aspects further includes controlling an operating temperature of a hydrocracking process of the integrated hydrocracking/hydrotreating reactor independently from an operating temperature of a hydrotreating process of the integrated hydrocracking/hydrotreating reactor.

Another aspect combinable with any of the previous aspects further includes based on the independent temperature control, controlling a sulphur concentration of diesel stream produced from the distillate stream.

Another aspect combinable with any of the previous aspects further includes based on the independent temperature control, controlling a naphtha mercaptan level of a fuel stream produced from the distillate stream.

One, some, or all of the implementations according to the present disclosure may include one or more of the following features. For example, implementations described in the present disclosure may allow for optimal processing of a residuum hydroconversion unit reactor effluent to maximize a middle distillate selectivity. As another example, implementations may allow for control of the reactor operating conditions (for example, pressure, temperature, and feed quality) of the distillate distinct from the gas oil, which allows for optimal product quality and utility requirements. Further, a use of a common gas loop may ensure or help ensure the lowest amount, or a reduced amount, of hydrogen solution loss in the system. Also, implementations according to the present disclosure may facilitate recycling of unconverted oil from a hydrofinishing section through a vacuum column to ensure maximum heavy polynuclear aromatics (HPNA) rejection with the unconverted residuum, thus maximizing a conversion of the entire complex. As yet another example, implementations according to the present disclosure may include a flow-scheme that optimizes equipment count and helps in reducing overall capital cost. For example, the example implementations of flow scheme may ensure that distillate products will meet ultra-low-sulfur diesel (ULSD) requirements and that naphtha mercaptan levels can also be controlled. Also, the combined effect of the staged flow operations according to the example implementations may ensure lower capital and operating cost when compared with conventional designs.

One or more terms used in the present disclosure may be understood as follows. The term "stream" can include various hydrocarbon molecules, such as straight chain, branched or cyclical alkanes, alkenes, alkadienes, and alkynes, as well as optionally other substances such as gases (for example, hydrogen, impurities). The stream can also include aromatic and nonaromatic compounds.

The term "zone" can refer to an area including one or more equipment items or one or more sub-zones (or both). Equipment items include one or more reactors or reactor vessels or reactor beds, heaters, exchangers, pipes, pumps, compressors and controllers. Additionally, an equipment item, such as reactor dryer or vessels, can further include one or more zones.

The term "rich" can mean an amount of at least generally about 40% and preferably about 45-70%, by mole, mass, or volume of a compound or class of compounds in a stream.

The term "substantially" can mean an amount of at least generally about 80%, preferably about 90%, and optimally about 99%, by mole, mass, or volume, of a compound or class of compounds in a stream.

The term "True Boiling Point" (TBP) means a test method for determining the boiling point of a material which corresponds to ASTM D2892 for the production of a liquefied gas, distillate fractions, and residuum of standardized quality on which analytical data can be obtained, and the determination of yields of the fractions by both mass and volume from which a graph of temperature versus mass percent distilled is produced using fifteen theoretical plates in a column with a 5:1 reflux ratio.

The term "D-86 distillation" (D86) means an atmospheric distillation using a laboratory batch distillation unit for determining the boiling point of a material which corresponds to the testing procedures set forth in ASTM D86 method. The test is method is designed for analysis for essentially distillate fuels (naphtha though gas oils) and is not applicable to products containing appreciable quantities of residuum.

The term "White Oil" means a hydrocarbon product which shall have TBP end point less than 370° Celsius (C). These may be hydrocarbons in the liquefied petroleum gas (LPG), naphtha, and distillate range.

The term "Distillate" means a hydrocarbon which shall have TBP range between 140-370° C. This may be a kerosene and diesel product.

The term "Gas Oil" means a hydrocarbon which shall have TBP range between 370-565° C. This may be derived as side cuts from a vacuum distillation column in the fractionation section.

The term "Residuum" means any hydrocarbon which has a TBP greater than 565° C. (such as vacuum tower bottom), resin, and pitch cuts from a solvent deasphalting unit, slurry oil from a fluid catalytic cracking, visbreaker, or thermal cracking unit residue The details of one or more implementations of the subject matter described in this disclosure are set forth in the accompanying drawings and the description. Other features, aspects, and advantages of the subject matter will become apparent from the description, the drawings, and the claims.

DETAILED DESCRIPTION

Figure 1:
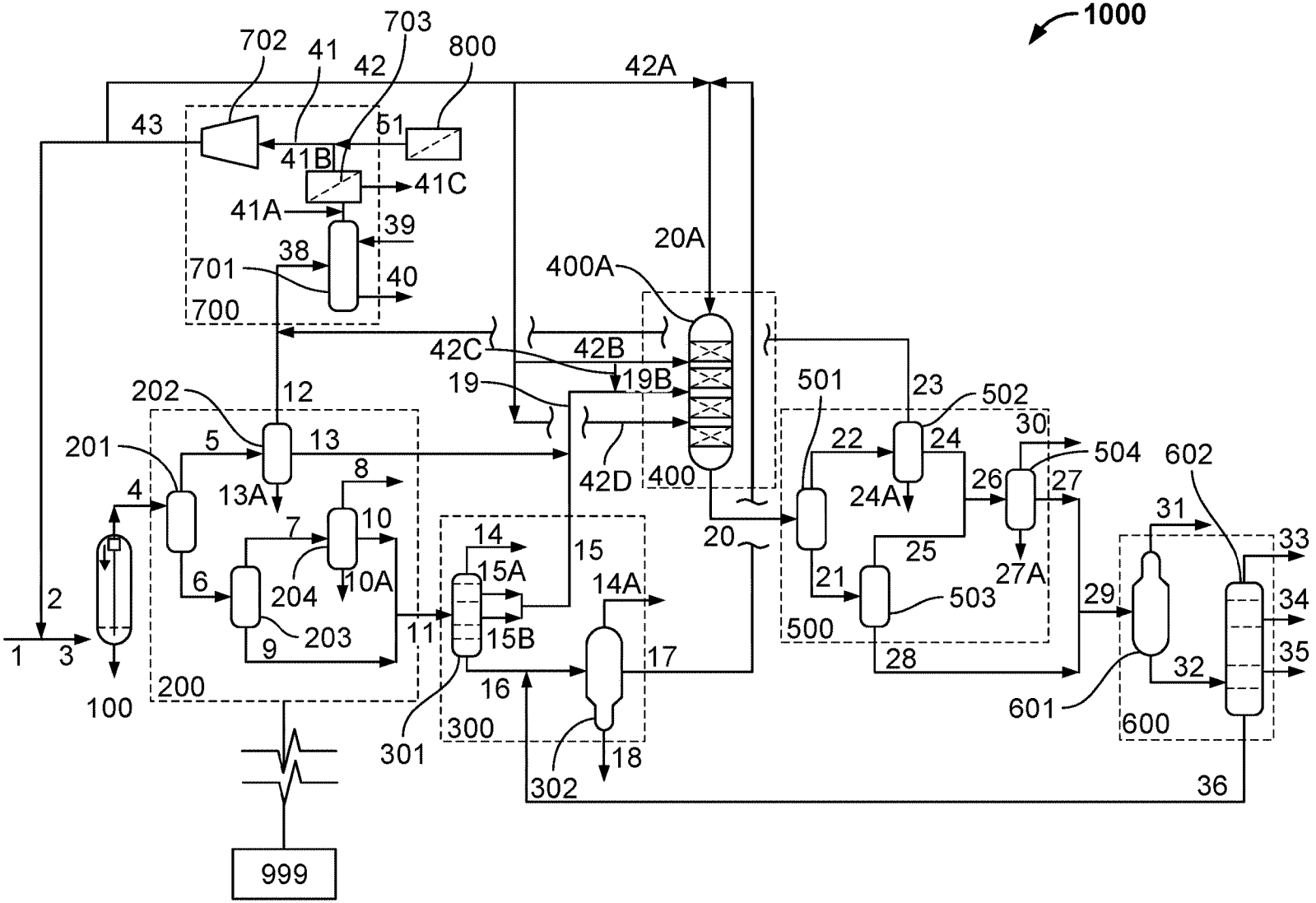
FIG. 1 depicts an example implementation of an integrated hydroprocessing system according to the present disclosure.

The present disclosure describes implementation of systems and processes for upgrading residuum hydrocarbon in an ebullated bed hydrocracking section, separating the reactant effluent in a separation vessels, and then fractionating the effluent. In some aspects, intermediate products produced are then hydrofinished in a staged manner in a combined hydrocracking and distillate hydrotreating section to produce one or more finished fuels products. In some aspects, the example implementations described in the present disclosure may optimize one or more hydroprocessing zones within the hydrofinishing section of an integrated residuum hydrocracking and hydrofinishing unit in order to, for instance, increase a selectivity of the overall distillate products. For instance, expected increase in distillate selectivity can be 2-4% based on a quantity of distillate amount present with the vacuum gas oil feed, rather than conventional processes which may either reduce the conversion per pass for recycle mode operation with accompanying higher hydraulic load or run to lower overall conversion with accompanying reduced yield for the same catalyst systems. A heavier portion of the effluent product is then fractionated in a multiple staged (for example, staged by pressure first in an atmospheric distillation column then vacuum distillation column) fractionation section to produce lighter products, heavy gas oils, and unconverted residuum.

For example, in some implementations, example processes may include contacting a residuum hydrocarbon fraction with hydrogen and a hydroconversion catalyst in a ebullated bed hydroconversion reactor to produce a partially converted reactor effluent product. In some aspects, the reactor effluent product may be separated into a substantially (for example, 80-85%) distillate minus stream (for example, a hydrocarbon stream boiling at a temperature less than the distillate TBP end point of 370° C.) of the distillate product make. The heavy gas oil fraction may then be contacted with hydrogen and a hydroconversion catalyst in a fixed bed hydrocracking reactor.

In some aspects, hydrotreating and hydrocracking reactions take place within the reactor (for example, within multiple catalyst beds) with hydrogen quenching (for example, with slip streams from a recycle gas compressor discharge) used between the multiple beds. A distillate minus stream produced from the ebullated bed hydroconversion section may be mixed with the distillate stream recovered in the ebullated bed hydroconversion fractionation section and routed at a bottom of a fixed bed hydrocracking reactor effluent bed to a post treat hydrotreating zone in order to ensure "ultra low sulfur" (for example, ULSD) distillate production, maximum suppression of mercaptan recombination and least amount of secondary cracking within the hydrocracking zone. The post treat hydrotreating zone temperatures may be independently controlled and catalyst volume and number of beds optimized for a given feed.

The effluent from this combined section may then be separated in a multiple separator/flash drum system, stripped, and fractionated to produce saleable fuel products. A common recycle gas loop and make up hydrogen system may be used for the residuum hydrocracking and hydrofinishing section. In some embodiments, the hydrofinishing section could have a recycle oil loop to increase conversion in the hydrocracking zone. Further, the hydrofinishing section may have a staggered hydrotreating zone (for example, the hydrotreating zone is separate from the hydrocracking zone) to optimize hydrotreating zone catalyst/equipment requirement or have a staged pressure hydrotreating zone for better gas utilization. Feed stock to the ebullated bed hydroconversion section may be primarily residuum, which is comprised of vacuum column bottom (with a nominal boiling point of 565° C.+), FCC slurry oil, deasphalting unit resin, or pitch or similar such heavy oil components from a refinery.

FIG. 1 depicts an example implementation of an integrated hydroprocessing system 1000 ("system 1000") according to the present disclosure. The system 1000, in the illustrated example implementation, includes several primary sub-systems. For example, as shown, system 1000 includes an ebullated bed hydroconversion reaction zone 100, a first separation zone 200, a heavy oil fractionation zone 300, a hydrofinishing reaction zone 400, a second separation zone 500, a white oil fractionation zone 600, a recycle gas section 700, and a make-up gas compressor 800.

In the illustrated implementation of system 1000, a stream 1 includes a hydrocarbon fraction (residuum) that is preheated and mixed with a preheated recycle gas stream 2. The mixed stream 3 is fed to the ebullated bed reactor zone 100. While only the reactor is shown 100, the zone 100 may include more than one reactors operating in series or parallel with or without inter-stage separation. The hydrocarbon and hydrogen are contacted with a hydroconversion catalyst to react at least a portion of the residuum in stream 1 (and mixed in stream 3) with the hydrogen to form lighter hydrocarbons. The reaction includes hydrodemetalization and Conradson carbon ("Concarbon") reduction of the residuum. The reactor effluent stream 4 is then circulated to the first separation zone 200.

The separation zone 200, in some aspects, includes separators that operate on temperature differences, pressure difference, or both. The effluent stream 4 first passes through a hot, high pressure separator 201, where a light stream 5 (for example, that boils at a temperature less than 370° Celsius (C)) is separated from a heavier stream 6. The light stream 5 is then cooled by heat exchange and sent to a cold high pressure separator 202. Wash water (not shown) may then be injected to stream 5, for example, to wash the sublimed ammonium salts produced in the reactor effluent 4 on account of the hydroconversion reactions. The amount water added may be adjusted to limit the concentration of the salt in the sour water. The cooled mixed stream 5 is then separated in a three phase cold separator 202, which outputs a vapor stream 12 (for example, that primarily contains hydrogen), a light liquid stream 13, and a sour water stream 13A.

In this example, the heavy oil stream 6 from the separator 201 is then flashed in a hot low pressure flash drum 203 to form two streams. A vapor stream 7 is then cooled and, in some aspects, may include injected wash water (not shown) to wash the sublimed ammonium salts produced in the reactor effluent 4 on account of the hydroconversion reactions and which is dissolved in the heavy hydrocarbon stream. The amount water added may be adjusted to limit the concentration of the salt in the sour water. The cooled stream 7 is then separated in a cold low pressure separator 204. The cold low pressure separator 204, in some aspects, is a three-phase separator. The vapor phase 8 output from the separator 204, which may be rich in hydrogen, is then treated (for example, outside of system 1000) where hydrogen is recovered. The sour water is withdrawn as stream 10A. The heavy cold hydrocarbon stream is withdrawn as stream 10.

As shown in the illustrated implementation, stream 9 is mixed with the preheated stream 10 to form stream 11 and is routed to the fractionation section 300. The fractionation section 300, in this example, includes atmospheric and vacuum distillation columns 301 and 302, respectively. The feed 11 to these fractionation columns 301 and 302 may be preheated in a series of heat exchangers and fired heaters as required. The atmospheric fractionation column 301 may be a trayed column having reflux, various pump-arounds, and side cuts. Light ends are withdrawn overhead as stream 14 and side cuts such as kerosene and diesel are withdrawn as side cuts 15*a* and 15*b*. Side cut stripping columns may be used where needed.

The light ends 14 are then stabilized, treated and split into Gas, LPG, and Naphtha cuts as required (not shown). The kerosene and diesels cuts (15A and 15B) are mixed to form a combined stream 15. A heavy hydrocarbon (for example, boiling at a temperature greater than 370° C.) stream 16 from the bottom of the atmospheric fractionation column 301 is mixed with the recycle oil stream 36 and routed to the vacuum column 302. The vacuum column 302, in some aspects, separates the gas oils and lighter fractions and rejects the unconverted oil from the ebullated bed hydroconversion zone 100 (for example, boiling at a temperature greater than 565° C.; unconverted residuum) as stream 18. Stream 18 may then be circulated as a fuel oil component to another processing unit. The gas oil streams 17 are withdrawn as side cuts, as shown.

In some aspects, the atmospheric distillation column 301 and the vacuum distillation column 302 may use stripping steam to aid stripping and improve the fractionation quality. The sour water produced from the fractionation section 300 (on account of condensing the steam; both stripping and that used for creating vacuum) are combined with stream 13A and 10A and routed to sour water stripping units (for example, outside of system 1000). The light ends 14A produced from the vacuum column 302 may be condensed in the steam ejector condenser system to form sour water, some oil slops and uncondensed gases at a "hot well" (not shown).

In this example, the gas oil stream 17 is mixed with a recycle gas stream 42A to form feed 20A, preheated, and sent to the hydrofinishing zone 400. The hydrofinishing zone 400, in this example, comprises an integrated hydrocracking/hydrotreating reactor 400A that includes an inlet for receiving this combined feed 20A and one or more inlets for receiving quench hydrogen streams 42B, 42C, 42D, and an intermediate hydrocarbon stream 19. Stream 19, in this example, is a combination of streams 13 and 15. Stream 19B is a mix of streams 19 and 42C. In general, the hydrofinishing reaction zone 400 can include the integrated hydrocracking/hydrotreating reactor 400A, which can have multiple catalyst beds and can receive quench hydrogen streams between the beds; a hydrocracking zone, which can have multiple catalyst beds and can receive quench hydrogen stream between the beds; and a hydrotreating zone which can also have multiple catalyst beds and received quench hydrogen stream between the beds and the distillate intermediate streams produced in the residuum hydroconversion separation and fractionation section.

Although only three hydrogen quench inlets are shown, the hydrogen streams (42B, 42C, 42D) can be provided anywhere along the integrated hydrocracking/hydrofinishing reactor 400A. Multiple hydrogen streams may be provided depending upon the number of beds in the reactor 400A. Thus, while the hydrotreating and hydrocracking of the gas oil streams are done on the top sections of the hydrofinishing reaction zone 400, the distillate hydrotreating of the intermediate stream and polishing of the hydrocracked effluent are conducted in the bottom hydrotreating section of the hydrofinishing zone 400. Although only one reactor is shown, there could be more than one reactor in series or parallel.

In the illustrated example, the effluent stream 20 from the reactor 400A is then sent to the second separation zone 500. The second separation zone 500, in some aspects, is similar to the first zone 200 and can include separators that operate on temperature differences, pressure difference, or both. The effluent stream 20 first passes through a hot high pressure separator 501, where a light stream 22 (for example, boiling at a temperature less than 370° C.) is separated from a heavy stream 21. The lighter stream 22 is then cooled through heat exchange and sent to a cold high pressure separator 502. Wash water (not shown), in some aspects, may be injected to stream 22 to dissolve the sublimated ammonium salts produced in the reactor effluent 20 on account of the hydrofinishing (hydrotreating and hydrocracking) reactions. The amount water added may be adjusted to limit the concentration of the salt in the sour water. Depending on the feed quality, this water injection could be intermittent and, if continuous, the quantity may be lower than that used in section 200. The cooled mixed stream 22 is then separated in a three phase cold separator 502 into a vapor stream 23 (for example, that substantially contains hydrogen), a light liquid stream 24, and a sour water stream 24A.

The heavy oil stream 21 from the separator 501 is then flashed in a hot low pressure flash drum 503 to form two streams 25 and 28. The vapor stream 25 is mixed and cooled with stream 24 to form stream 26. This stream 26 is then separated in a cold low pressure separator 504. The cold low pressure separator 504, in some aspects, is a three-phase separator. The vapor phase 30 (which may be rich in hydrogen) is then treated (for example, outside of system 1000) and hydrogen recovered similar to stream 8. The sour water is withdrawn as stream 27A. This sour water stream 27A, if formed, may be on account of the dissolved water with the feed to the hydrofinishing section or intermittent wash if used (injected to stream 25). The heavy cold hydrocarbon stream is withdrawn as stream 27.

In this example, stream 28 is mixed with preheated stream 27 to form stream 29. Stream 29, as shown, is routed to the product fractionation section 600. The fractionation section 600, in this example, includes a stripping column 601 followed by an atmospheric column 602. Stream 29 is sent to the stripping column 601 for light end and hydrogen sulfide ($H_2S$) stripping. The light ends are removed as stream 31 and are then treated (not shown) along with stream 14.

The stripped effluent stream 32 is then preheated (for example, in heat exchangers and fired heaters) and sent to the atmospheric fractionation column 602. The atmospheric fractionation column 602, in some aspects, is a trayed column having reflux, various pump-arounds and side cuts. Light ends are withdrawn overhead as stream 33 and side cuts, such as kerosene and diesel that meet ultra-low sulfur product requirements, are withdrawn as side cuts 34 and 35. Side cut stripping columns may be used in order to meet flash point requirements for the distillate products (not shown). The light ends 33 may then be stabilized, treated, and split into gas, LPG, and Naphtha cuts as required (not shown), which may be a common to the entire unit. The unconverted oil (essentially unconverted gas oil) is the heavy stream 36 that is withdrawn from the bottom of the column 602 and recycled back to the hydrofinishing zone 300 (for example, to the vacuum column 302). The stripping column 601 and atmospheric distillation column 602, in some aspects, use stripping steam to aid stripping and improve the fractionation quality. The sour water produced from the stripping column 601 is routed for to the sour water stripping unit, while the water condensed in the atmospheric column 602 overhead is recycled back as one of streams used in the wash water injection.

As shown in this implementation, the vapor stream 12 from cold high pressure separator 202 and stream 23 from separator 502 mix and form stream 38. Stream 38 enters an amine scrubbing column 701 of the recycle gas section 700. This column 701, in some aspects, may be a tray or packed (or combination of both) column where the gas stream 38 is scrubbed against amine stream 39. The $H_2S$ in the gas stream 38 may be absorbed by the amine, which leaves the column 701 from the bottom as a rich amine stream 40 that can be sent to any suitable destination, such as an amine regeneration system. The essentially $H_2S$ free gas stream 41A, which may substantially contain hydrogen, is further purified through a membrane system 703. The high purity hydrogen stream 41B is then is then sent to a recycle gas compressor 702. The rejected stream 41C is sent for further processing for purification in downstream units. The recycle compressor discharge streams 43 from the compressor 701 then splits into two streams, 2 and 42. Stream 42 is routed to the hydrofinishing section 400 and branches as multiple streams 42A through 42D, which include inter-bed quench streams.

As illustrated, make-up high purity hydrogen, which may be required for the reaction, is compressed to a reaction zone pressure in the make-up gas compression zone 800. The substantially hydrogen rich gas 51 from a hydrogen generation unit in the zone 800 is mixed with the gas stream 41. The make-up compressor 702, in some aspects, may be a multistage reciprocating compressor, and gas can be added at the recycle gas compressor discharge or suction (for example, based on economic reasons).

In some aspects of system 1000, the illustrated ebullated bed hydroconversion may be carried out in a reaction temperature range of between 400° C. and 440° C. A reaction pressure may be in the range of between 70 bar (atmospheric) and 170 bar (atmospheric) (hydrogen partial pressure). The liquid hourly space velocities may be in the range of 0.1-0.5 $hour^{-1}$ ($hr^{-1}$) and conversion to 565° C. minus TBP range hydrocarbons may be in the range of 30-80%.

The hydrofinishing section 400, in some aspects, includes a hydrocracking zone and a hydrotreating zone. The hydrocracking may be carried out in a reaction temperature range of 360° C. to 420° C. and a reaction pressure in the range of from 70 bar (atmospheric) to 170 bar (atmospheric) (hydrogen partial pressure). The conversion in the hydrocracking zone may be in the range of 50-98%; the liquid hourly space velocity 0.5-3 $hr^{-1}$. The hydrotreating is a carried in a reaction temperature range 320° C. to 400° C. and a reaction pressure in the range of from 40 bar (atmospheric) to 170 bar (atmospheric) (hydrogen partial pressure). In some aspects, with a liquid hourly space velocity of 1-10 $hr^{-1}$, produced distillate products may meet a sulfur specification of less than 10 weight parts per million (ppm).

In some example, the operating conditions for the hot high pressure separator 501 are at a temperature in the range of from 200° C. to 450° C., and a pressure in the range of from 90 bar gauge (barg) to 170 barg. In some aspects, the operating conditions for the cold high pressure separator 502 are at a temperature in the range of from 40° C. to 100° C. and a pressure in the range of from 90 barg to 170 barg. In some aspects, the operating conditions for the hot low pressure separator 503 (or flash drum) are at a temperature in the range of from 200° C. to 450° C. and a pressure in the range of from 30 barg to 70 barg. In some aspects, the operating conditions for the cold low pressure separator 504 (or flash drum) are at a temperature in the range of from 40° C. to 100° C. and a pressure in the range of from 30 barg to 70 barg. In some aspects, the operating conditions for the stripping column 601 are at a temperature of the flash zone in the range of from 200° C. to 300° C. and a pressure in the range of from 5 barg to 20 barg. In some aspects, operating conditions for the atmospheric distillation column 601 are at a temperature of the flash zone in the range of from 350° C. to 375° C. and a pressure in the range of from 1.5 barg to 5 barg. In some aspects, operating conditions for the vacuum distillation column 602 are at a temperature of the flash zone in the range of from 390° C. to 420° C. and a pressure in the range of from 90-25 millimeters of mercury (mm Hg).

The hydroconversion reactor 100 (400A and B in some aspects) may contain a catalyst having at least one Group VIII metal, and at least one Group VIB metal. The Group VIII metal may be, for example, one or more of iron, cobalt, or nickel. The Group VIB metal may be, for example, one or more of molybdenum or tungsten. The Group VIII metal can be present in the amount of about 2-20% by weight, and the Group VIB metal can be present in the amount of about 1-25% by weight. In some aspects, these metals may be included on a support material, such as silica or alumina, or a mix of both. Additional acidity in the form of zeolites may be present for hydrocracking catalysts and a promoter, such as Group XV oxides, may be actively present for the residue conversion and hydrotreating catalysts.

Figure 2:
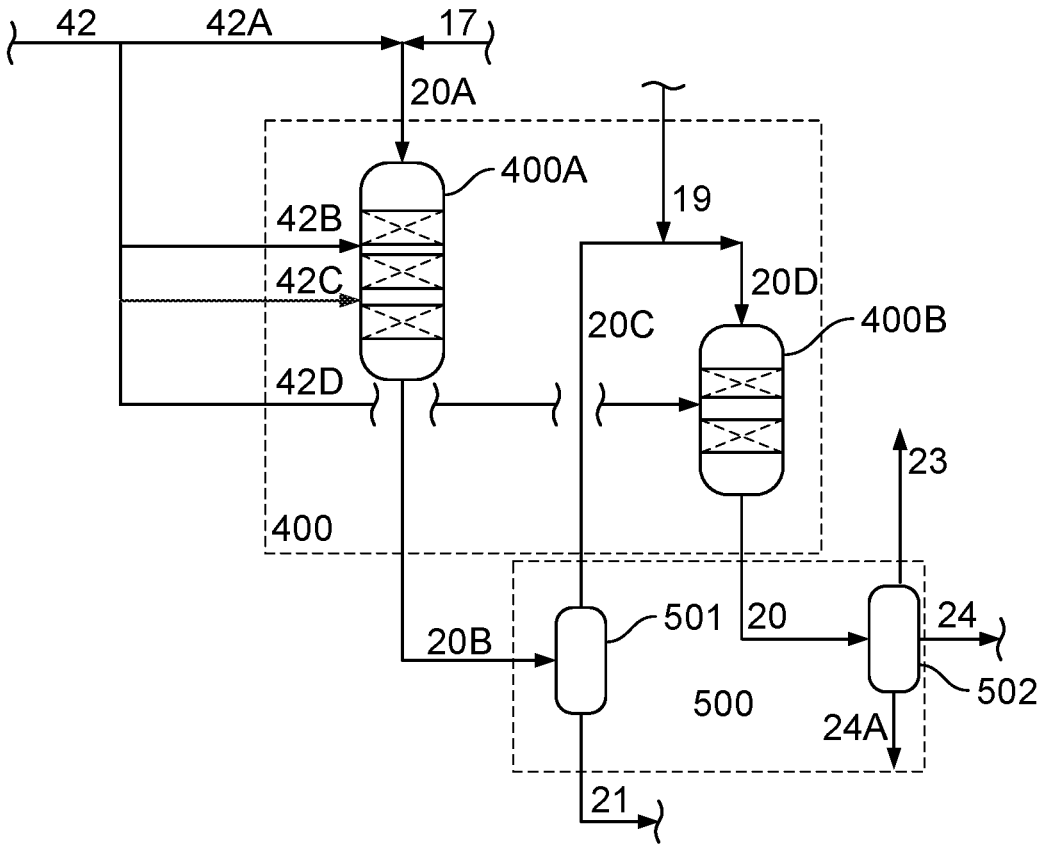
FIG. 2 depicts an example implementation of a hydrofinishing reaction zone of an integrated hydroprocessing system according to the present disclosure.

FIG. 2 depicts an example implementation of the hydrofinishing reaction zone 400 of the integrated hydroprocessing system 1000 according to the present disclosure. FIG. 2 illustrates, more specifically, another implementation of the hydrofinishing reaction zone 400 that is different than the zone 400 that is illustrated in FIG. 1. For example, as shown, the hot high pressure separator 501, in this example, is placed between the hydrotreating and hydrocracking zone and the distillate hydrotreating zone. As shown, stream 17 mixes with recycle gas stream 42A and is preheated. The mixed stream is routed to the hydrocracking/hydrotreating reactor 400A as stream 20A. The hydrocracked effluent 20B is then routed to the hot high pressure separator 501.

The vapor stream 20C from separator 501 is then mixed with stream 19, which is preheated and routed to a polishing hydrotreating reactor 400B. Reactor 400B, in some aspects, includes an inlet for receiving this combined feed 20D and an inlet for receiving quench hydrogen stream 42D. Although only one hydrogen quench inlet is shown, in some aspects, the hydrogen stream 42D can be provided anywhere along the reactor 400B and multiple hydrogen streams may be provided depending upon the number of beds. The hydrotreated product stream 20 from the reactor is cooled and separated in a cold high pressure separator 502. The vapor stream from 502 (in other words, stream 23) is sent to the amine scrubber. Intermittent sour water (when water is injected; not shown) is withdrawn as stream 24A. The hydrotreated distillate and lighter streams, stream 24, and the hydrocracked stream 21 are then processed as described with respect to FIG. 1.

Figure 3:
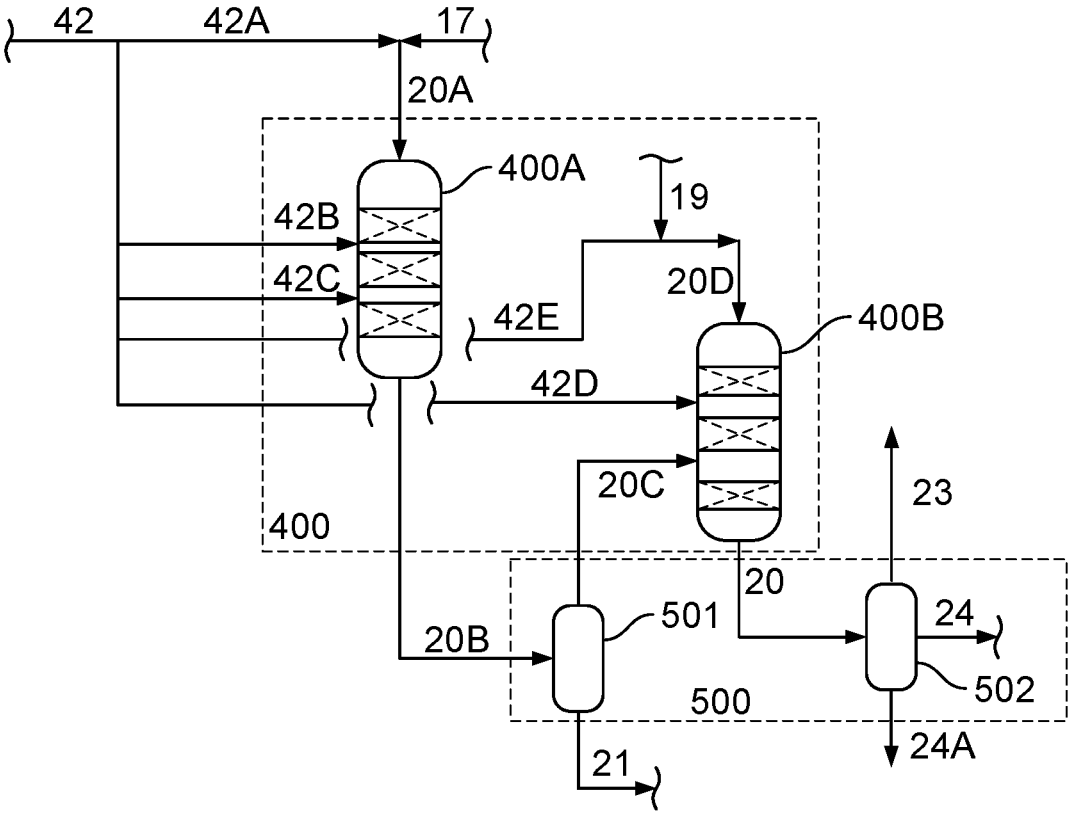
FIG. 3 depicts another example implementation of a hydrofinishing reaction zone of an integrated hydroprocessing system according to the present disclosure.

FIG. 3 depicts another example implementation of the hydrofinishing reaction zone 400 of the integrated hydroprocessing system 1000 according to the present disclosure. FIG. 3 illustrates, more specifically, another implementation of the hydrofinishing reaction zone 400 that is different than the zone 400 that is illustrated in FIGS. 1 and 2. For example, in the implementation of FIG. 3, the hydrotreating is carried out in parallel with the hydrocracking section. For example, stream 17 mixes with recycle gas stream 42A, is preheated, and routed to the reactor 400A as stream 20A. Similarly, the distillate stream 19 mixes with the recycle gas stream 42E, is preheated, and routed to the hydrotreating reactor 400B as stream 20D. The hydrocracked effluent 20B is then routed to the hot high pressure separator 501.

The vapor stream 20C from the separator 501 is then routed to a top of a bottom bed of the polishing hydrotreating reactor 400B. Reactor 400B includes an inlet for receiving the preheated distillate and recycle gas stream 20D and an inlet for receiving the quench hydrogen stream 42D and the vapor stream 20C. Although only one hydrogen quench inlet is shown, the hydrogen stream 42D can be provided anywhere along the reactor 400B and multiple hydrogen streams may be provided depending upon the number of beds of the reactor 400B. The hydrotreated product stream 20 from the reactor is cooled and separated in the cold high pressure separator 502. The vapor stream from the separator 502 (in other words, stream 23) is sent to the amine scrubber. Intermittent sour water (when injected; not shown) is withdrawn as stream 24A. The hydrotreated distillate and lighter streams, stream 24, and the hydrocracked stream 21 are then processed similar to the implementation described in FIG. 1. In some aspects, a catalyst amount placed in the bottom bed of the reactor 400B may be tailored for post treat of the hydrocracked vapor effluent (stream 20C) in order to ensure that mercaptan recombination is eliminated over the entire cycle. In some aspects, this may be achieved by independent temperature and catalyst quantity control.

Figure 4:
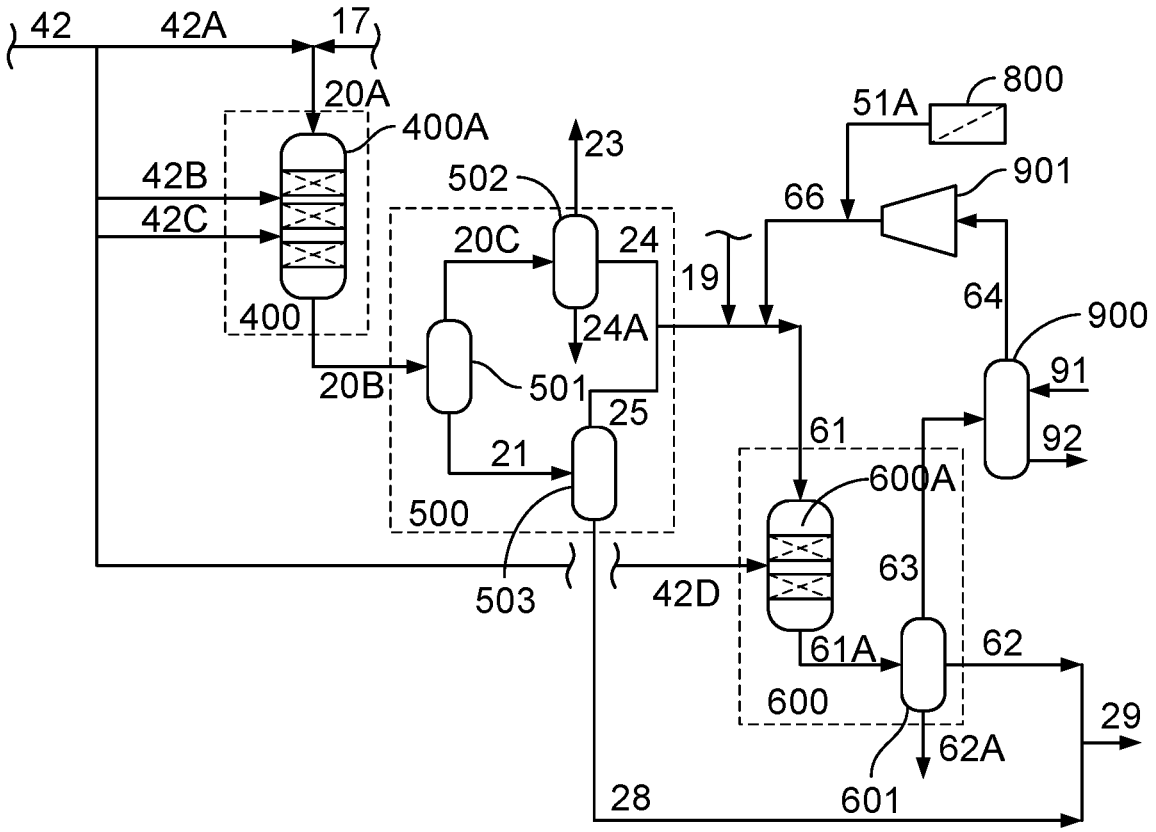
FIG. 4 depicts an example implementation of a hydrotreating section of a hydrofinishing reaction zone, along with an added amine scrubber section and recycle gas compression section, of an integrated hydroprocessing system according to the present disclosure.

FIG. 4 depicts an example implementation of the hydrotreating section of the hydrofinishing reaction zone 400, along with an added amine scrubber section 900 and recycle gas compression section 800, of the integrated hydroprocessing system 1000 according to the present disclosure. For example, the implementation shown in FIG. 4 includes a hydrotreating zone of the hydrofinishing section that is carried out at a lower pressure as compared to the implementation shown in FIG. 1. For example, as shown, stream 17 mixes with recycle gas stream 42A and is preheated and routed to the reactor 400A as stream 20A. The hydrocracked effluent 20B is then routed to the hot high pressure separator 501. The effluent 20B first passes through the hot high pressure separator 501 where a light stream 20C (for example, boiling at a temperature less than 370° C.) is separated from a heavier stream 21.

The lighter stream 20C is then cooled in a heat exchanger and sent to the cold high pressure separator 502. Wash water (not shown), in some aspects, may be injected into stream 20C to dissolve the sublimated ammonium salts produced in the reactor effluent. Depending on the feed quality, this water injection could be intermittent and, if continuous, the quantity may be lower than that used in section 200. The cooled mixed stream 20C is separated in the three phase cold separator 502 into a vapor stream 23 (which substantially contains hydrogen), a light liquid stream 24, and a sour water stream 24A.

As illustrated in this implementation, the heavy oil stream 21 from the separator 501 is flashed in a hot low pressure flash drum 503 to form two streams 25 and 28. The vapor stream 25 is mixed with stream 24, stream 19, and a low pressure recycle gas stream 66 to form stream 61. Stream 61 is preheated and routed to the polishing hydrotreating reactor 600A. Reactor 600A includes an inlet for receiving this combined feed 61 and an inlet for receiving quench hydrogen streams 42D. Although only one hydrogen quench inlet is shown, the hydrogen stream 42D can be provided anywhere along the reactor and multiple hydrogen streams may be provided depending upon the number of beds.

The reactor effluent 61A is then cooled and sent to the cold low pressure separator 601. In some aspects, the cold low pressure separator is a three-phase separator. The vapor phase 63 (which is rich in hydrogen) is then routed to the low pressure amine scrubber column 900. This column 900, in some aspects, is a tray or packed (or combination of both) column where the gas stream 63 is scrubbed against amine stream 91. The $H_2S$ in the gas stream 63, for example, is absorbed by the amine which leaves the column 900 from the bottom as a rich amine stream 92 that can be sent to any suitable destination, such as an amine regeneration system. An $H_2S$-free gas stream 64 (which substantially contains hydrogen) may then be sent to a low pressure recycle gas compressor 901.

The gas stream 64 is compressed and mixed with make-up gas 51A from, for example, an intermediate stage of the make-up gas compressor 800, to form the recycle gas stream 66. Quench gas for inter-bed quench in the polishing hydrotreating reactor 600A can alternately be provided from a slip stream of 66 if needed. The sour water from 601 may also be withdrawn as stream 62A. This sour water, if formed, may be on account of the dissolved water with the feed to the hydrotreating section or intermittent wash if used (injected to stream 61A; not shown). The hydrocarbon stream 62 mixes with the hot stream 28 to form stream 29. Processing of stream 29 is then similar to that as described with reference to FIG. 1.

Figure 5:
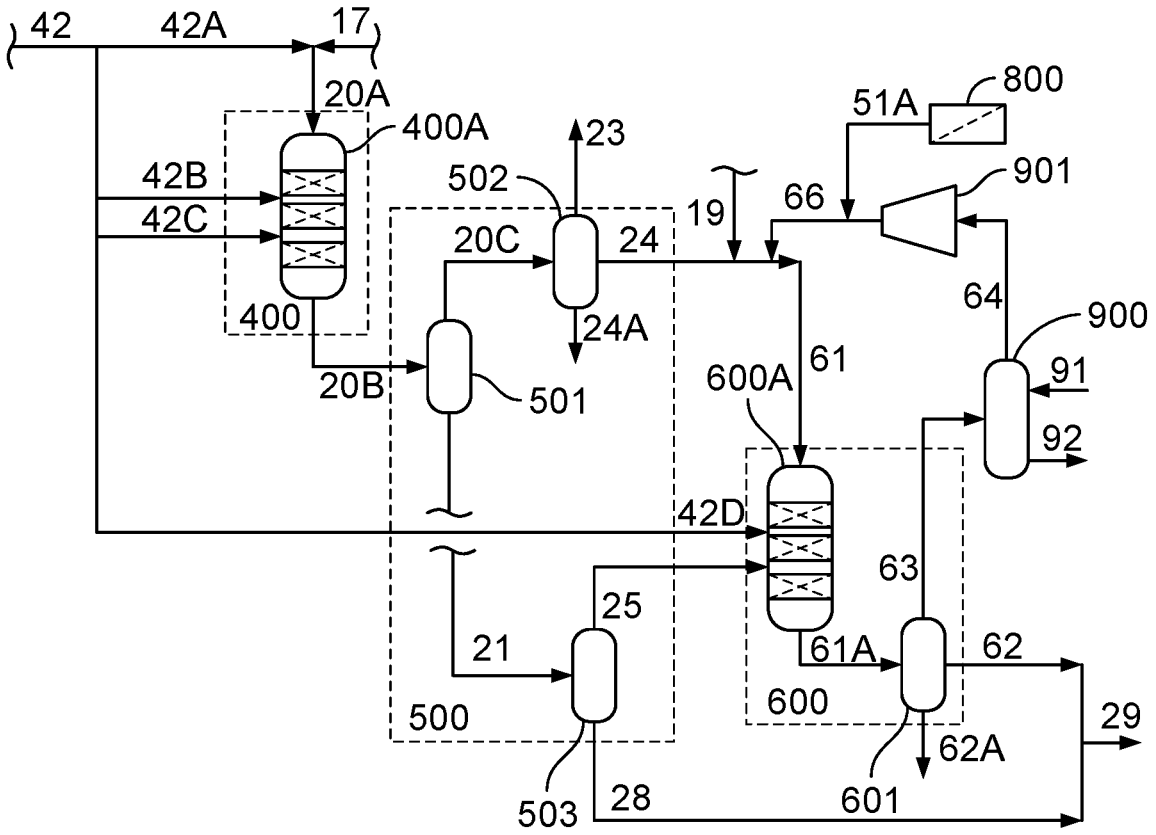
FIG. 5 depicts another example implementation of a hydrotreating section of a hydrofinishing reaction zone, along with an added amine scrubber section and recycle gas compression section, of an integrated hydroprocessing system according to the present disclosure.

FIG. 5 depicts another example implementation of the hydrotreating section of the hydrofinishing reaction zone 400, along with the added amine scrubber section 900 and recycle gas compression section 800, of the integrated hydroprocessing system 1000 according to the present disclosure. For example, in the illustrated implementation of FIG. 5, the hydrotreating zone of the hydrofinishing section 400 is carried out at a lower pressure and with an independent hydrocracked vapor effluent mercaptan recombination control bed as compared to the previous implementations. For example, as shown in FIG. 5, stream 17 mixes with recycle gas stream 42A and is preheated and routed to the reactor 400A as stream 20A. The hydrocracked effluent 20B is then routed to the hot high pressure separator 501. The effluent 20B first passes through the hot high pressure separator 501, where a light stream 20C (for example, that boils at a temperature less than 370° C.) is separated from the heavier stream 21.

The light stream 20C is then cooled with a heat exchanger and sent to the cold high pressure separator 502. Wash water (not shown) may be injected to stream 20C to dissolve the sublimated ammonium salts produced in the reactor effluent 20B. For example, depending on the feed quality, this water injection could be intermittent and, if continuous, the quantity may be lower than that used in section 200. The cooled mixed stream 20C is separated in the three phase cold separator 502 into a vapor stream 23 (which substantially contains hydrogen), a light liquid stream 24, and a sour water stream 24A.

The heavy oil stream 21 from the separator 501 is then flashed in the hot low pressure flash drum 503 to form two streams 25 and 28. Stream 24, stream 19, and low pressure recycle gas stream 66 are mixed to form stream 61. Stream 61 is preheated and routed to the polishing hydrotreating reactor 600A. Reactor 600A includes an inlet for receiving this combined feed 61 and an inlet for receiving the quench hydrogen streams 42D and the vapor stream 25 from the hot low pressure flash drum 503. Although only one hydrogen quench inlet is shown, the hydrogen stream 42D can be provided anywhere along the reactor 600A and multiple hydrogen streams may be provided depending upon the number of beds.

The reactor effluent 61A is then cooled and sent to the cold low pressure separator 601. The cold low pressure separator 601, in some aspects, is a three-phase separator. The vapor phase 63 (which is rich in hydrogen) is then routed to the low pressure amine scrubber column 900. The column 900, in some aspects, is a traditional tray or packed (or combination of both) column, where the gas stream 63 is scrubbed against amine stream 91. The $H_2S$ in the gas is absorbed by the amine which leaves the column 900 from the bottom as a rich amine stream 92 that can be sent to any suitable destination, such as an amine regeneration system.

The $H_2S$ free gas stream 64 (which substantially contains hydrogen) is then sent to the low pressure recycle gas compressor 901. The gas stream 64 is compressed and mixed with make-up gas 51A from the intermediate stage of the make-up gas compressor 800 to form the recycle gas stream 66. Quench gas for inter-bed quench in the reactor 600A can alternately be provided from a slip stream of 66 if needed. The sour water from 601 is withdrawn as stream 62A. This sour water, if formed, may be on account of the dissolved water with the feed to the hydrotreating section or intermittent wash if used (injected to stream 61A; not shown). The hydrocarbon stream 62 mixes with the hot stream 28 to form stream 29. Processing of stream 29 is then similar to that described with reference to FIG. 1.

System 1000 may also be implemented with additional or alternative features as those described with reference to FIGS. 1-5. For example, in some implementations of the system 1000, the hydrocracking of gas oil can be on a "once-through" basis. In such a scenario, stream 36 may not be recycled but is sent to storage or to another process for further processing if required. In additional implementations, since the hydrotreating and hydrocracking zones can be independently controlled and operated, external feed can be supplemented, such as highly aromatic feed stocks that may include a hydroprocessing upgrade to meet petroleum refining fuel qualities.

System 1000 may be controlled (for example, control of temperature, pressure, flowrates of fluid, or a combination of such parameters) to provide for a desired output given particular inputs. In some aspects, a flow control system for system 1000 can be operated manually. For example, an operator can set a flow rate for a pump or transfer device and set valve open or close positions to regulate the flow of the process streams through the pipes in the flow control system. Once the operator has set the flow rates and the valve open or close positions for all flow control systems distributed across the system, the flow control system can flow the streams under constant flow conditions, for example, constant volumetric rate. To change the flow conditions, the operator can manually operate the flow control system, for example, by changing the pump flow rate or the valve open or close position.

In some aspects, a flow control system for system 1000 can be operated automatically. For example, as further shown in FIG. 1, system 1000 includes a control system 999 that is communicably coupled to the components and sub-systems (for example, sub-systems 100, 200, 300, 400, 500, 600, 700, 800, 900) of system 1000. The control system 999 can include or be connected to a computer or control system to operate system 1000. The control system 999 can include a computer-readable medium storing instructions (such as flow control instructions) executable by one or more processors to perform operations (such as flow control operations). An operator can set the flow rates and the valve open or close positions for all flow control systems distributed across the facility using the control system 999. In such embodiments, the operator can manually change the flow conditions by providing inputs through the control system 999. Also, in such embodiments, the control system 999 can automatically (that is, without manual intervention) control one or more of the flow control systems, for example, using feedback systems connected to the control system 999. For example, a sensor (such as a pressure sensor, temperature sensor) can be connected to a pipe through which a process stream flows. The sensor can monitor and provide a flow condition (such as a pressure, temperature) of the process stream to the control system 999. In response to the flow condition exceeding a threshold (such as a threshold pressure value, a threshold temperature value), the control system 999 can automatically perform operations. For example, if the pressure or temperature in the pipe exceeds the threshold pressure value or the threshold temperature value, respectively, the control system 999 can provide a signal to the pump to decrease a flow rate, a signal to open a valve to relieve the pressure, or a signal to shut down process stream flow.

Control system 999 can be implemented in digital electronic circuitry, or in computer hardware, firmware, software, or in combinations of them. The apparatus can be implemented in a computer program product tangibly embodied in an information carrier, for example, in a machine-readable storage device for execution by a programmable processor; and method steps can be performed by a programmable processor executing a program of instructions to perform functions of the described implementations by operating on input data and generating output. The described features can be implemented advantageously in one or more computer programs that are executable on a programmable system including at least one programmable processor coupled to receive data and instructions from, and to transmit data and instructions to, a data storage system, at least one input device, and at least one output device. A computer program is a set of instructions that can be used, directly or indirectly, in a computer to perform a certain activity or bring about a certain result. A computer program can be written in any form of programming language, including compiled or interpreted languages, and it can be deployed in any form, including as a stand-alone program or as a module, component, subroutine, or other unit suitable for use in a computing environment.

Suitable processors for the execution of a program of instructions include, by way of example, both general and special purpose microprocessors, and the sole processor or one of multiple processors of any kind of computer. Generally, a processor will receive instructions and data from a read-only memory or a random access memory or both. The essential elements of a computer are a processor for executing instructions and one or more memories for storing instructions and data. Generally, a computer will also include, or be operatively coupled to communicate with, one or more mass storage devices for storing data files; such devices include magnetic disks, such as internal hard disks and removable disks; magneto-optical disks; and optical disks. Storage devices suitable for tangibly embodying computer program instructions and data include all forms of non-volatile memory, including by way of example semiconductor memory devices, such as erasable programmable read-only memory (EPROM), electrically erasable programmable read-only memory (EEPROM), and flash memory devices; magnetic disks such as internal hard disks and removable disks; magneto-optical disks; and CD-ROM and DVD-ROM disks. The processor and the memory can be supplemented by, or incorporated in, ASICs (application-specific integrated circuits).

To provide for interaction with a user, the features can be implemented on a computer having a display device such as a CRT (cathode ray tube) or LCD (liquid crystal display) monitor for displaying information to the user and a keyboard and a pointing device such as a mouse or a trackball by which the user can provide input to the computer.

Additionally, such activities can be implemented via touch-screen flat-panel displays and other appropriate mechanisms.

The features can be implemented in a control system that includes a back-end component, such as a data server, or that includes a middleware component, such as an application server or an Internet server, or that includes a front-end component, such as a client computer having a graphical user interface or an Internet browser, or any combination of them. The components of the system can be connected by any form or medium of digital data communication such as a communication network. Examples of communication networks include a local area network ("LAN"), a wide area network ("WAN"), peer-to-peer networks (having ad-hoc or static members), grid computing infrastructures, and the Internet.

While this specification contains many specific implementation details, these should not be construed as limitations on the scope of what may be claimed, but rather as descriptions of features specific to particular implementations. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described as acting in certain combinations and even initially claimed as such, one or more features from a claimed combination can in some cases be excised from the combination, and the claimed combination may be directed to a subcombination or variation of a sub combination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the implementations described should not be understood as requiring such separation in all implementations, and it should be understood that the described program components and systems can generally be integrated together in a single software product or packaged into multiple software products.

A number of implementations have been described. Nevertheless, it will be understood that various modifications may be made without departing from the spirit and scope of the disclosure. For example, example operations, methods, or processes described here may include more steps or fewer steps than those described. Further, the steps in such example operations, methods, or processes may be performed in different successions than that described or illustrated in the figures. Accordingly, other implementations are within the scope of the following claims Further modifications and alternative implementations of various aspects will be apparent to those skilled in the art in view of this description. Accordingly, this description is to be construed as illustrative only. It is to be understood that the forms shown and described are to be taken as examples of implementations. Elements and materials may be substituted for those illustrated and described, parts and processes may be reversed, and certain features may be utilized independently, all as would be apparent to one skilled in the art after having the benefit of this description. Accordingly, the description of example implementations does not define or constrain this disclosure. Other changes, substitutions, and alterations are also possible without departing from the spirit and scope of this disclosure.

What is claimed is:

1. A method for processing residuum, the method comprising:

receiving a feed stream that comprises a residuum hydrocarbon fraction at an ebullated bed hydroconversion reactor;

contacting the residuum hydrocarbon fraction with hydrogen and a hydroconversion catalyst in the ebullated bed hydroconversion reactor to produce a partially converted reactor effluent product;

separating, in a first separation zone, the partially converted reactor effluent product into a distillate stream and a heavy hydrocarbon stream;

feeding the distillate stream to a hydrofinishing reaction zone that comprises an integrated hydrocracking/hydrotreating reactor;

feeding the heavy hydrocarbon stream to a top portion of the integrated hydrocracking/hydrotreating reactor;

feeding an effluent stream from the integrated hydrocracking/hydrotreating reactor to a second separation zone;

separating, in a high temperature, high pressure separator of the second separation zone, the effluent stream into a light stream and a heavy oil stream;

feeding the light stream to a polishing hydrotreating reactor of the hydrofinishing reaction zone; and feeding the heavy oil stream to a high temperature, low pressure separator of the second separation zone, wherein the integrated hydrocracking/hydrotreating reactor comprises multiple catalyst beds and is configured to receive one or more quench hydrogen quench streams between the catalyst beds, and the integrated hydrocracking/hydrotreating reactor comprises a hydrocracking zone that includes a portion of the multiple catalyst beds and a hydrotreating zone that includes another portion of the multiple catalyst beds.

2. The method of claim 1, further comprising:

combining, to form a mixed stream, the heavy hydrocarbon stream with a recycle gas stream prior to feeding the heavy hydrocarbon stream to the top portion of the integrated hydrocracking/hydrotreating reactor; and feeding the mixed stream to the top portion of the integrated hydrocracking/hydrotreating reactor.

3. The method of claim 2, further comprising:

prior to feeding the heavy hydrocarbon stream to the top portion of the integrated hydrocracking/hydrotreating reactor, fractionating the heavy hydrocarbon stream into a light hydrocarbon stream, a heavy gas oil stream, and an unconverted residuum stream in a vacuum distillation column;

feeding the heavy gas oil stream to the top portion of the integrated hydrocracking/hydrotreating reactor; and contacting the heavy gas oil stream with hydrogen and hydroconversion catalyst in the integrated hydrocracking/hydrotreating reactor.

4. The method of claim 3, further comprising:

combining a light liquid stream from a low temperature, high pressure separator of the first separation zone with a first mixed stream from a fractionation column;

subsequent to the combining, feeding the combined stream to a top portion of the polishing hydrotreating reactor;

feeding the light stream from the high temperature, high pressure separator of the second separation zone to the top portion of the polishing hydrotreating reactor;

supplying a particular hydrogen quench stream of the one or more hydrogen quench streams to the polishing hydrotreating reactor;

mixing the combined stream of the light liquid stream and the first mixed stream with the light stream and the hydrogen quench stream to form a second mixed stream;

subsequent to the mixing, feeding the second mixed stream to the top portion of the polishing hydrotreating reactor; and outputting an effluent from the polishing hydrotreating reactor to a low temperature, high pressure separator of the second separation zone.

5. The method of claim 2, further comprising:

prior to feeding the heavy hydrocarbon stream to the top portion of the integrated hydrocracking/hydrotreating reactor, fractionating the heavy hydrocarbon stream into a light hydrocarbon stream, a heavy gas oil stream, and an unconverted residuum stream in a vacuum distillation column.

6. The method of claim 5, further comprising:

feeding the heavy gas oil stream to the top portion of the integrated hydrocracking/hydrotreating reactor; and contacting the heavy gas oil stream with hydrogen and hydroconversion catalyst in the integrated hydrocracking/hydrotreating reactor.

7. The method of claim 6, further comprising:

prior to feeding the distillate stream to the hydrofinishing reaction zone that comprises the integrated hydrocracking/hydrotreating reactor, mixing the distillate stream with light liquid stream recovered from a low temperature, high pressure separator of the first separation zone; and feeding the mixed stream to the hydrofinishing reaction zone that comprises the integrated hydrocracking/hydrotreating reactor.

8. The method of claim 1, further comprising:

prior to feeding the heavy hydrocarbon stream to the top portion of the integrated hydrocracking/hydrotreating reactor, fractionating the heavy hydrocarbon stream into a light hydrocarbon stream, a heavy gas oil stream, and an unconverted residuum stream in a vacuum distillation column.

9. The method of claim 8, further comprising:

feeding the heavy gas oil stream to the top portion of the integrated hydrocracking/hydrotreating reactor; and contacting the heavy gas oil stream with hydrogen and hydroconversion catalyst in the integrated hydrocracking/hydrotreating reactor.

10. The method of claim 1, wherein the polishing hydrotreating reactor comprises a multiple bed reactor.

11. The method of claim 1, further comprising supplying at least one hydrogen quench stream of the one or more hydrogen quench streams to the polishing hydrotreating reactor.

12. The method of claim 1, further comprising:

prior to feeding the distillate stream to the hydrofinishing reaction zone, mixing the distillate stream with light liquid stream recovered from a low temperature, high pressure separator of the first separation zone to form a mixed stream.

13. The method of claim 1, further comprising:

controlling an operating temperature of a hydrocracking process of the integrated hydrocracking/hydrotreating reactor independently from an operating temperature of a hydrotreating process of the integrated hydrocracking/hydrotreating reactor;

based on the independent temperature control, controlling a sulphur concentration of a diesel stream; and based on the independent temperature control, controlling a naphtha mercaptan level of a fuel stream.

14. The method of claim 1, further comprising:

combining the light stream with a mixed stream from a low temperature, high pressure separator of the first separation zone;

subsequent to the combining, feeding the combined stream to the polishing hydrotreating reactor; and outputting an effluent from the polishing hydrotreating reactor to a low temperature, high pressure separator of the second separation zone.

15. The method of claim 14, further comprising:

supplying a hydrogen quench stream of the one or more hydrogen quench streams to the polishing hydrotreating reactor;

mixing the combined stream with a recycle gas stream; and subsequent to the mixing, feeding the combined stream and recycle gas stream to a top portion of the polishing hydrotreating reactor.

16. The method of claim 15, further comprising:

controlling an operating temperature of a hydrocracking process of the integrated hydrocracking/hydrotreating reactor independently from an operating temperature of a hydrotreating process of the integrated hydrocracking/hydrotreating reactor;

based on the independent temperature control, controlling a sulphur concentration of a diesel stream; and based on the independent temperature control, controlling a naphtha mercaptan level of a fuel stream.

17. A method for processing residuum, the method comprising:

receiving a feed stream that comprises a residuum hydrocarbon fraction at an ebullated bed hydroconversion reactor;

contacting the residuum hydrocarbon fraction with hydrogen and a hydroconversion catalyst in the ebullated bed hydroconversion reactor to produce a partially converted reactor effluent product;

separating, in a first separation zone, the partially converted reactor effluent product into a distillate stream and a heavy hydrocarbon stream;

feeding the distillate stream to a hydrofinishing reaction zone that comprises an integrated hydrocracking/hydrotreating reactor;

feeding the heavy hydrocarbon stream to a top portion of the integrated hydrocracking/hydrotreating reactor;

feeding an effluent stream from the integrated hydrocracking/hydrotreating reactor to a second separation zone;

separating, in a high temperature, high pressure separator of the second separation zone, the effluent stream into a light stream and a heavy oil stream;

feeding the light stream to a polishing hydrotreating reactor of the hydrofinishing reaction zone;

feeding the heavy oil stream to a high temperature, low pressure separator of the second separation zone;

controlling an operating temperature of a hydrocracking process of the integrated hydrocracking/hydrotreating reactor independently from an operating temperature of a hydrotreating process of the integrated hydrocracking/hydrotreating reactor;

based on the independent temperature control, controlling a sulphur concentration of a diesel stream; and based on the independent temperature control, controlling a naphtha mercaptan level of a fuel stream.

18. The method of claim 17, further comprising:

combining, to form a mixed stream, the heavy hydrocarbon stream with a recycle gas stream prior to feeding the heavy hydrocarbon stream to the top portion of the integrated hydrocracking/hydrotreating reactor; and feeding the mixed stream to the top portion of the integrated hydrocracking/hydrotreating reactor.

19. The method of claim 18, further comprising:

prior to feeding the heavy hydrocarbon stream to the top portion of the integrated hydrocracking/hydrotreating reactor, fractionating the heavy hydrocarbon stream into a light hydrocarbon stream, a heavy gas oil stream, and an unconverted residuum stream in a vacuum distillation column;

feeding the heavy gas oil stream to the top portion of the integrated hydrocracking/hydrotreating reactor; and contacting the heavy gas oil stream with hydrogen and hydroconversion catalyst in the integrated hydrocracking/hydrotreating reactor.

20. The method of claim 19, further comprising:

combining a light liquid stream from a low temperature, high pressure separator of the first separation zone with a first mixed stream from a fractionation column;

subsequent to the combining, feeding the combined stream to a top portion of the polishing hydrotreating reactor;

feeding the light stream from the high temperature, high pressure separator of the second separation zone to the top portion of the polishing hydrotreating reactor;

supplying a particular hydrogen quench stream of the one or more hydrogen quench streams to the polishing hydrotreating reactor;

mixing the combined stream of the light liquid stream and the first mixed stream with the light stream and the hydrogen quench stream to form a second mixed stream;

subsequent to the mixing, feeding the second mixed stream to the top portion of the polishing hydrotreating reactor; and outputting an effluent from the polishing hydrotreating reactor to a low temperature, high pressure separator of the second separation zone.

21. The method of claim 18, further comprising:

prior to feeding the heavy hydrocarbon stream to the top portion of the integrated hydrocracking/hydrotreating reactor, fractionating the heavy hydrocarbon stream into a light hydrocarbon stream, a heavy gas oil stream, and an unconverted residuum stream in a vacuum distillation column.

22. The method of claim 21, further comprising:

feeding the heavy gas oil stream to the top portion of the integrated hydrocracking/hydrotreating reactor; and contacting the heavy gas oil stream with hydrogen and hydroconversion catalyst in the integrated hydrocracking/hydrotreating reactor.

23. The method of claim 22, further comprising:

prior to feeding the distillate stream to the hydrofinishing reaction zone that comprises the integrated hydrocracking/hydrotreating reactor, mixing the distillate stream with light liquid stream recovered from a low temperature, high pressure separator of the first separation zone; and feeding the mixed stream to the hydrofinishing reaction zone that comprises the integrated hydrocracking/hydrotreating reactor.

24. The method of claim 17, further comprising:

prior to feeding the heavy hydrocarbon stream to the top portion of the integrated hydrocracking/hydrotreating reactor, fractionating the heavy hydrocarbon stream into a light hydrocarbon stream, a heavy gas oil stream, and an unconverted residuum stream in a vacuum distillation column.

25. The method of claim 24, further comprising:

feeding the heavy gas oil stream to the top portion of the integrated hydrocracking/hydrotreating reactor; and contacting the heavy gas oil stream with hydrogen and hydroconversion catalyst in the integrated hydrocracking/hydrotreating reactor.

26. The method of claim 17, wherein the integrated hydrocracking/hydrotreating reactor comprises a multiple bed reactor.

27. The method of claim 17, further comprising supplying at least one hydrogen quench stream to the integrated hydrocracking/hydrotreating reactor.

28. The method of claim 17, further comprising:

prior to feeding the distillate stream to the hydrofinishing reaction zone, mixing the distillate stream with light liquid stream recovered from a low temperature, high pressure separator of the first separation zone to form a mixed stream.

29. The method of claim 17, further comprising:

combining the light stream with a mixed stream from a low temperature, high pressure separator of the first separation zone;

subsequent to the combining, feeding the combined stream to the polishing hydrotreating reactor; and outputting an effluent from the polishing hydrotreating reactor to a low temperature, high pressure separator of the second separation zone.

30. The method of claim 29, further comprising:

supplying a hydrogen quench stream of the one or more hydrogen quench streams to the polishing hydrotreating reactor;

mixing the combined stream with a recycle gas stream; and subsequent to the mixing, feeding the combined stream and recycle gas stream to a top portion of the polishing hydrotreating reactor.

31. The method of claim 17, wherein the integrated hydrocracking/hydrotreating reactor comprises multiple catalyst beds and is configured to receive one or more quench hydrogen quench streams between the catalyst beds.

32. The method of claim 31, wherein the integrated hydrocracking/hydrotreating reactor comprises a hydrocracking zone that includes a portion of the multiple catalyst beds and a hydrotreating zone that includes another portion of the multiple catalyst beds.

* * * * *